United States Patent [19]

Smith

[11] Patent Number: 4,836,270

[45] Date of Patent: Jun. 6, 1989

[54] CONSUMABLE DEFLECTOR TENT

[75] Inventor: Jack L. Smith, South Bend, Ind.

[73] Assignee: Design Packaging, Inc., South Bend, Ind.

[21] Appl. No.: 163,480

[22] Filed: Feb. 16, 1988

[51] Int. Cl.[4] ..... B22D 7/12

[52] U.S. Cl. ..... 164/412; 164/134; 249/205

[58] Field of Search ..... 164/134, 337, 412; 249/204, 205, 206

[56] References Cited

U.S. PATENT DOCUMENTS 2,864,141 12/1958 Vallak ..... 249/206

3,730,252 5/1973 Schnurrenberger ..... 164/134

*Primary Examiner*—Richard K. Seidel

*Attorney, Agent, or Firm*—Thomas J. Dodd

[57] ABSTRACT

A consumable tent which is positioned above a metal mold before pouring of the molten metal. The tent is formed of one or more sheets of corrugated stock which angle is downwardly and outwardly of the mold to deflect sand away from the mold interior. The tent defines an opening spanned by a cover which is consumed by the molten metal to allow the metal to reach the mold through the opening.

3 Claims, 8 Drawing Sheets

CONSUMABLE DEFLECTOR TENT

SUMMARY OF THE INVENTION

This invention relates to deflector tents, and will have special application to a consumable deflector tent which deflects sand and other solid impurities away from a mold during the pouring of a molten metal ingot.

The presence of sand in a poured steel ingot will reduce the quality of the steel and also the value of a particular ingot dependant upon the amount of sand present. A quantity of sand and other impurities is often present in the bottom of the pouring bucket. Due to the almost simultaneous nature of the sand-metal pour, it is practically impossible to first pour out the sand, then close the gate and, after repositioning, pour the metal into the mold. Previous attempts in constructing deflector tents for the sand failed for various reasons.

The tent of this invention includes a sheet or sheets formed preferably of durable, consumable material such as corrugated paper. The tent is positioned above and supported atop the mold and defines a center opening spanned by a cover. The cover is formed of relatively weaker corrugated material of sufficient strength to deflect the sand but allow passage of the molten metal without splashing or deflection. As the molten metal continues to be poured into the mold, the tent prevents further splashing of metal out of the mold.

Accordingly, it is an object of this invention to provide a deflector tent which is for deflecting sand away from a metal mold prior to pouring the molten metal.

Another object of this invention is to provide for a sand deflecting tent which also limits splashing of the molten metal out of the mold during a pour.

Another object of this invention is to provide a deflector tent which is formed of heat consumable materials which do not lower the value of a metal ingot in the event of mixture.

Still another object of this invention is to provide for a deflector tent which defines an opening spanned by a cover which readily allows the passage of molten metal into the mold.

Other objects of this invention will become apparent upon a reading of the following description.

BRIEF DESCRIPTION OF THE DRAWINGS

A preferred embodiment has been depicted for purposes for illustration wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to utilize the invention.

Figure 1:
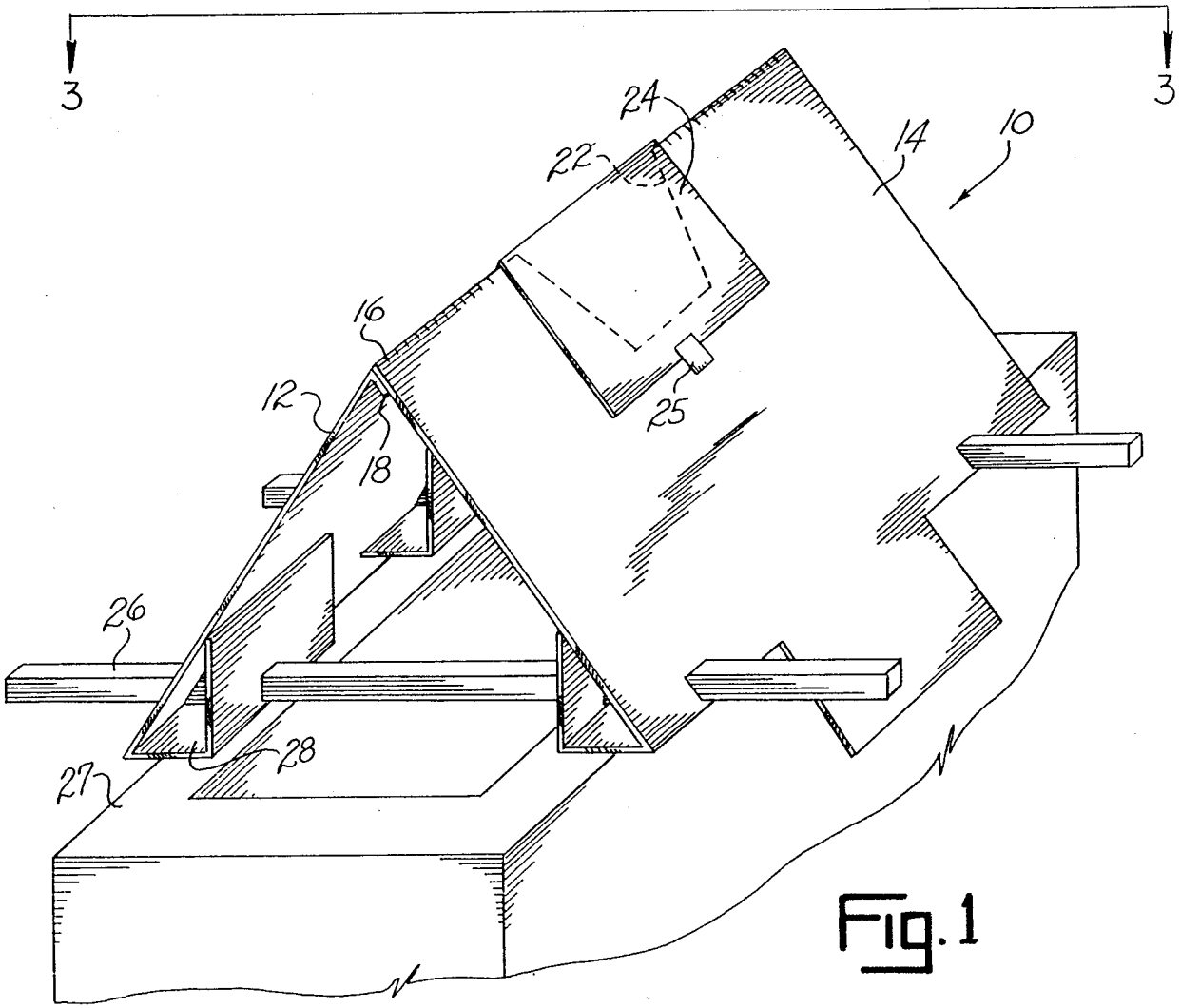
FIG. 1 is a perspective view of the tent shown supported atop a metal mold.
Figure 2:
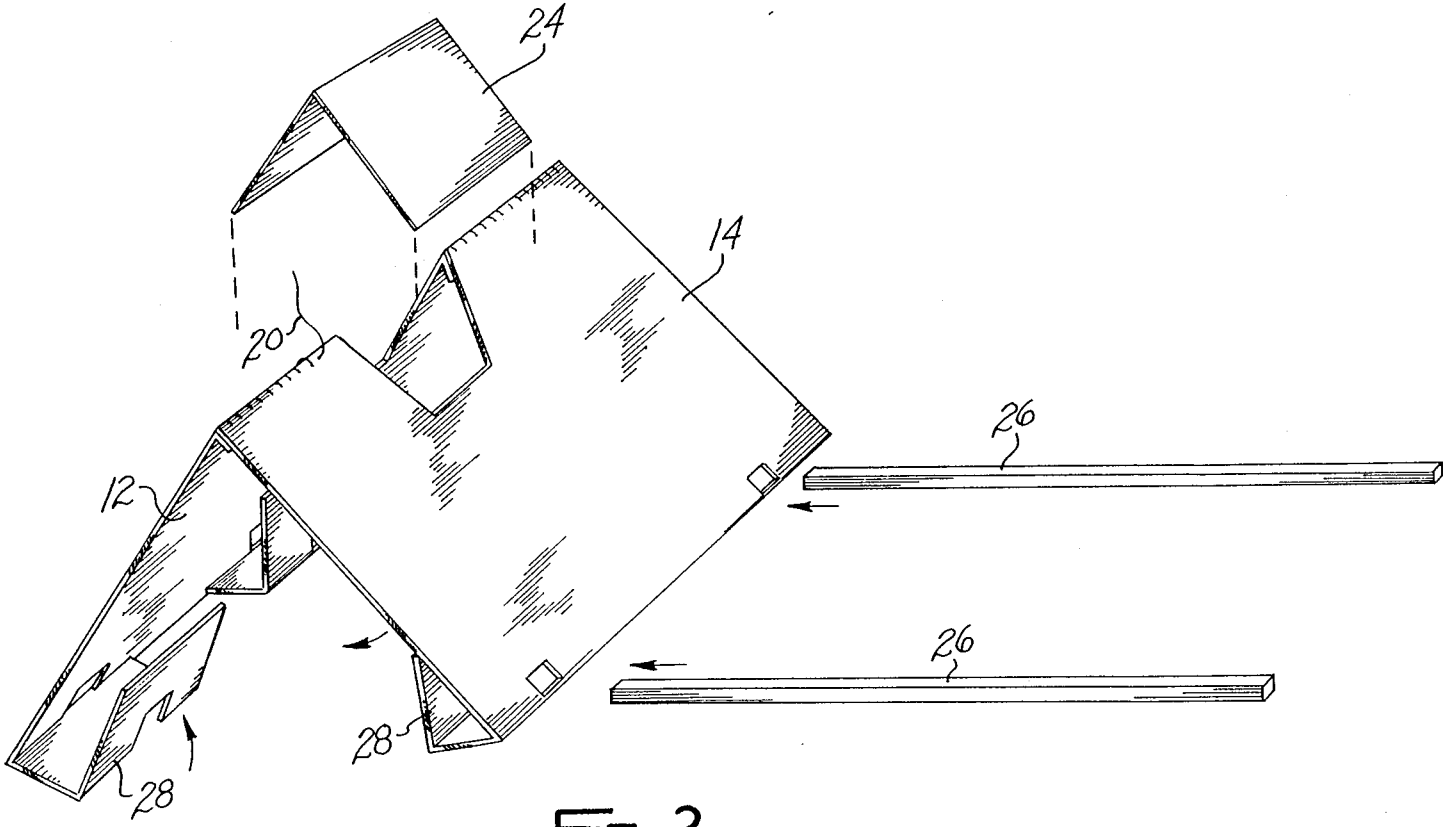
FIG. 2 is an exploded view of the tent.
Figure 3:
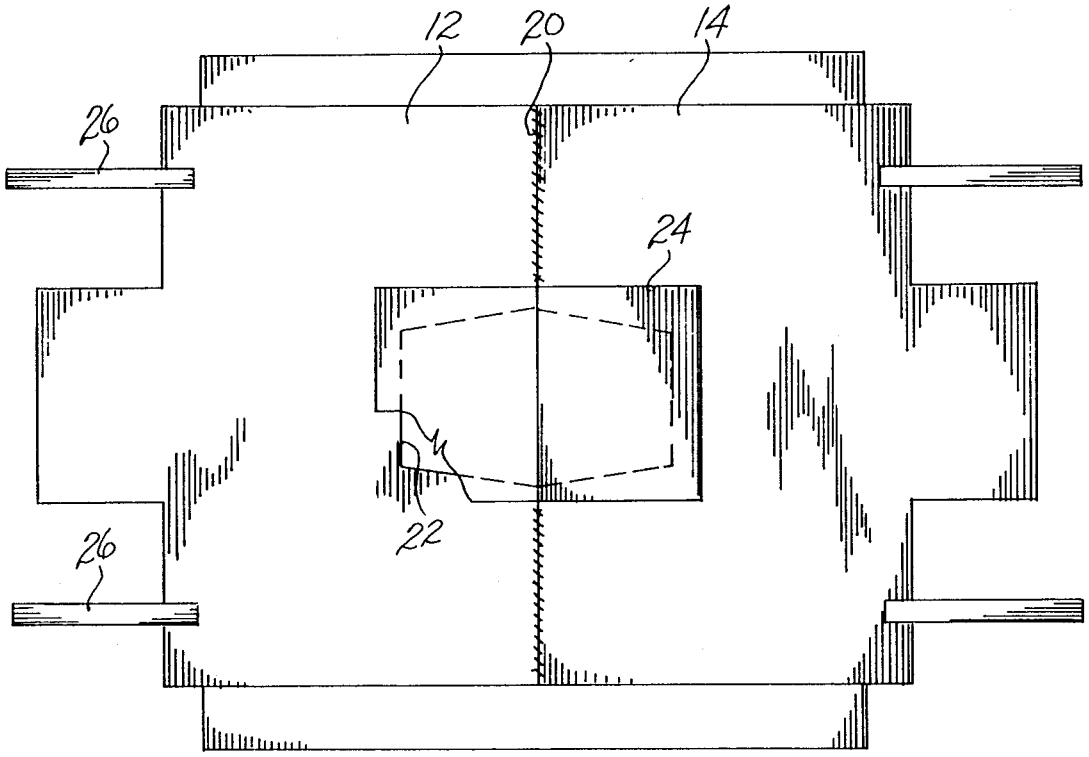
FIG. 3 is a top plan view as seen from line 3—3 of FIG. 1.

Referring now to the drawings, reference numeral 10 generally refers to the deflector tent of this invention. Tent 10 includes sheets 12, 14 preferably formed of corrugated paper joined at their top edges 16, 18 such as by stitching 20. Tent 10 may also be formed of a single sheet of material folded at the top and angled downwardly as shown in FIG. 1. The corrugated paper used to form sheets 12, 14 is preferably of a triple wall thickness (1100 pound test) in order to withstand the initial force of the poured molten steel.

Figure 7:
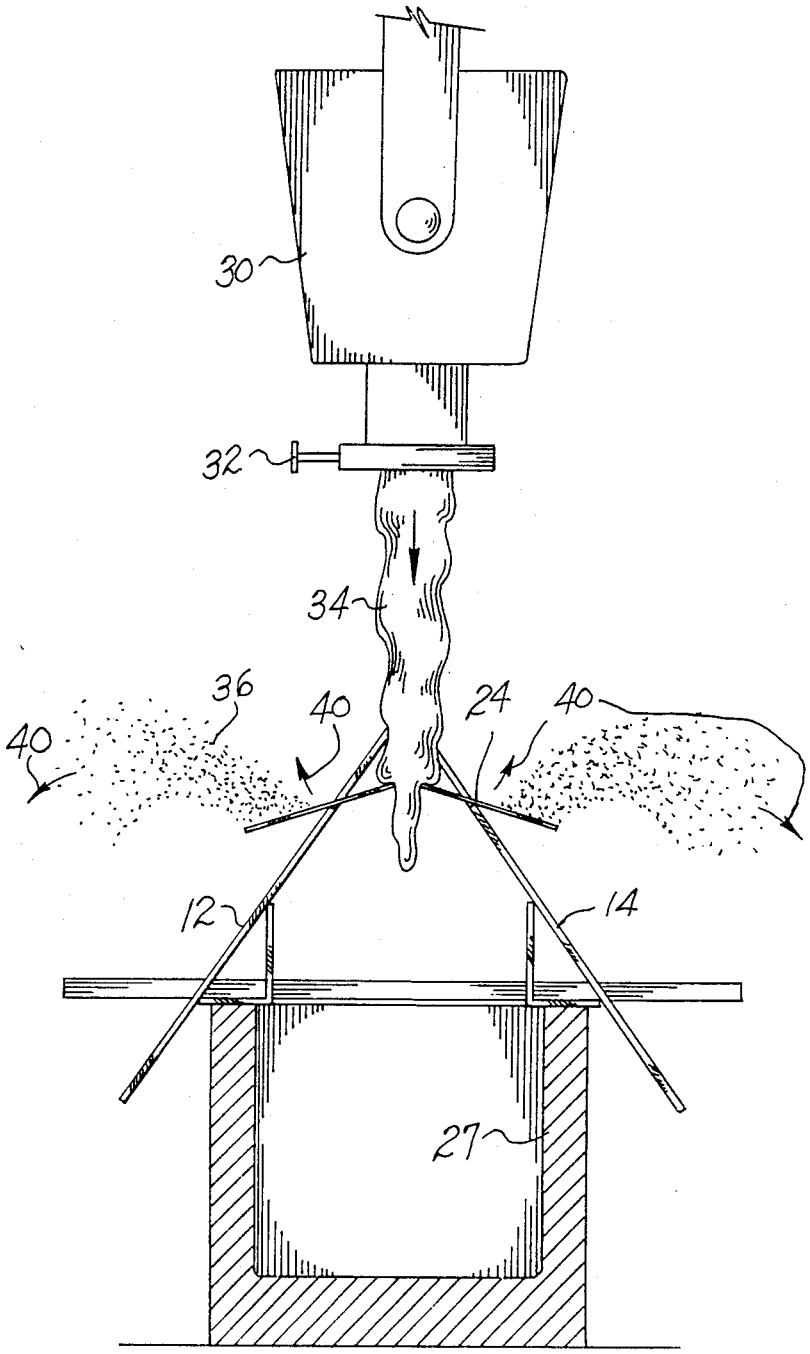

An opening 22 is defined in tent 10 sufficiently large to allow molten steel to pass through without contacting sheets 12, 14. Opening 22 may be of the hexagonal shape shown in the drawings, or alternatively, of any desired shape which allows passage of the molten steel. A cover 24, preferably formed of a single wall folded corrugated sheet (125 pound test), is positioned over opening 22 as shown and is secured to sheet 12, 14 as by gluing or by tape 26 so as to allow the cover to flip outwardly when hit by the molten steel column as shown in FIG. 7. It should be noted here that the corrugations (not shown) in tent 10 and cover 24 must run with the slope (not across) for sufficient strength to be realized.

Sheets 12, 14 as shown in FIG. 1, may be supported atop an ingot mold 27 by wood beams 26 which extend through inwardly folded corner flaps 28 of the sheets which rest atop the ingot mold 27. Beams 26 support the tent against collapsing during the initial pour time. Alternatively, other means may be used to support the tent 10 atop ingot mold 27 such as corrugated beams or integral corrugated flanges.

Figure 4:
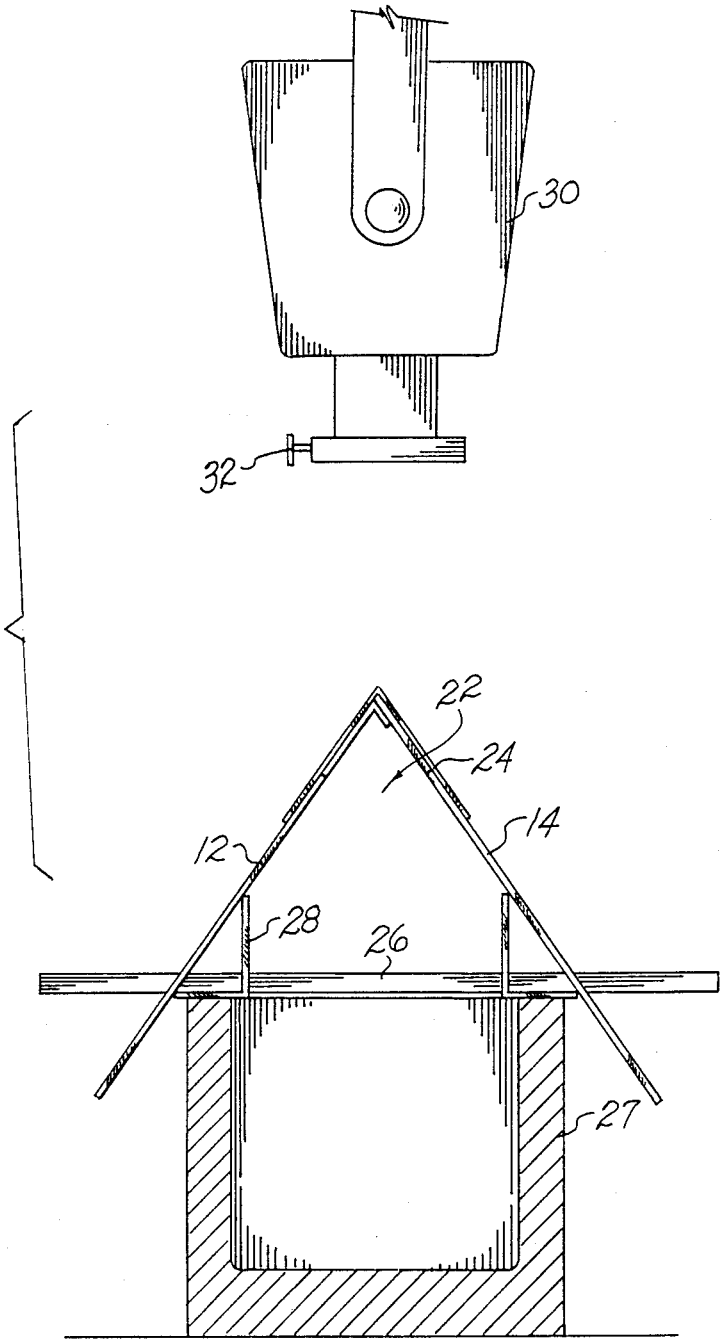
FIG. 4 is a sectional view of the mold and tent prior to pouring.
Figure 5:
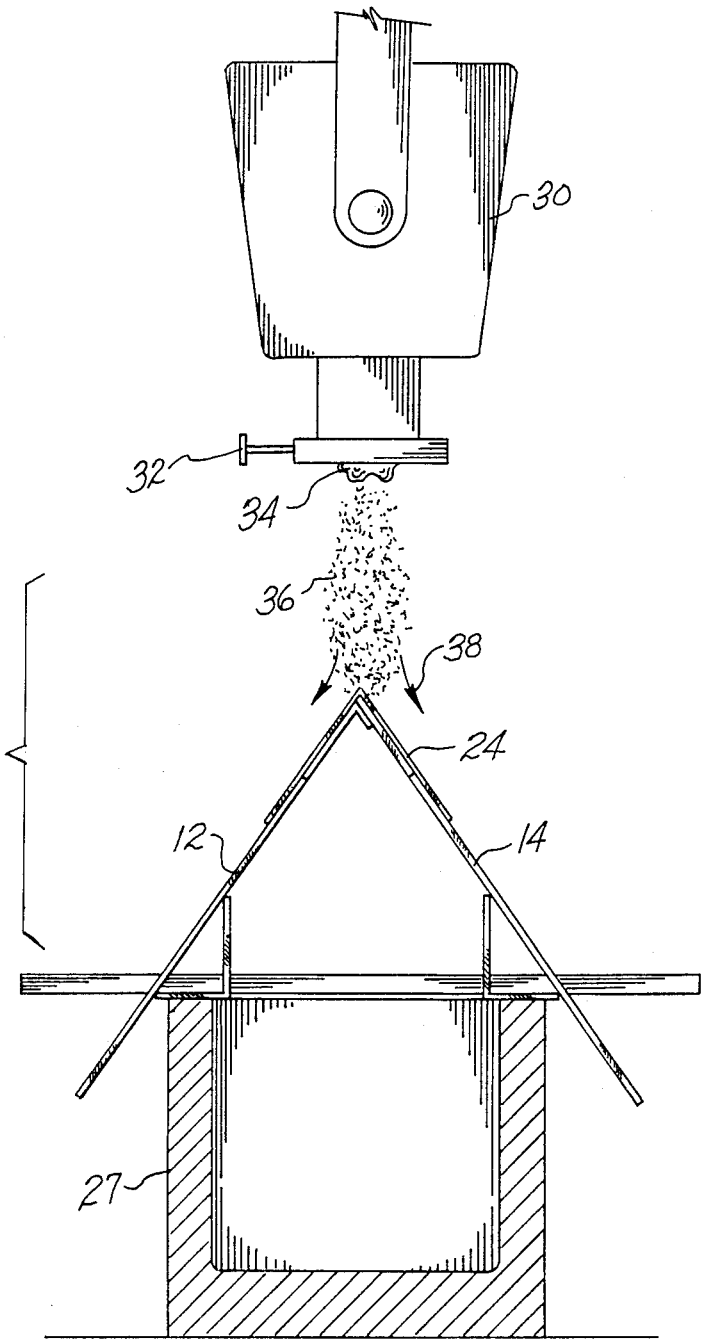
FIGS. 5–8 are sectional views similar to FIG. 4 showing in sequence the pouring of the sand and molten metal into the mold.
Figure 6:
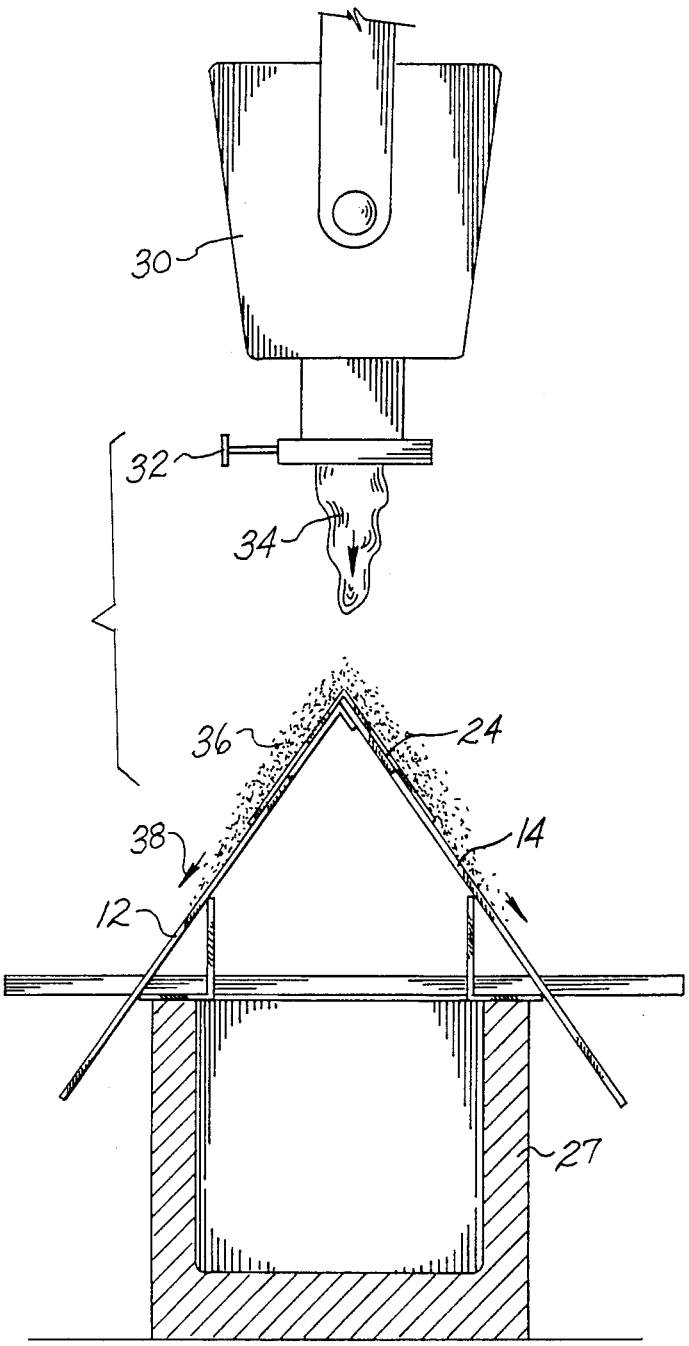

FIGS. 4–8 depict in sequence the operation of tent 10 during a steel ingot initial pour. FIG. 4 depicts the tent 10 in position atop mold 27 just prior to the pouring of the molten steel column from bucket 30. Bucket 30 is preferably positioned directly over opening 22 which is spanned by cover 24, such that the molten steel column will pass directly through the opening without contacting sheets 12, 14 of tent 10. FIG. 5 illustrates the pouring sequence just after opening valve 32 of bucket 30 to release molten steel 34. As shown in FIG. 5, sand and other solid impurities 36 in the steel (which are heavier and thus migrate by gravity to the bottom of bucket 30) are poured first and contact cover 24. Due to the strength of the cover 24 material and the angled orientation thereof, inpurities 36 are deflected in the direction of arrows 38 down the sides of tent sheets 12, 14 away from mold 27 as shown in FIG. 6.

Figure 8:
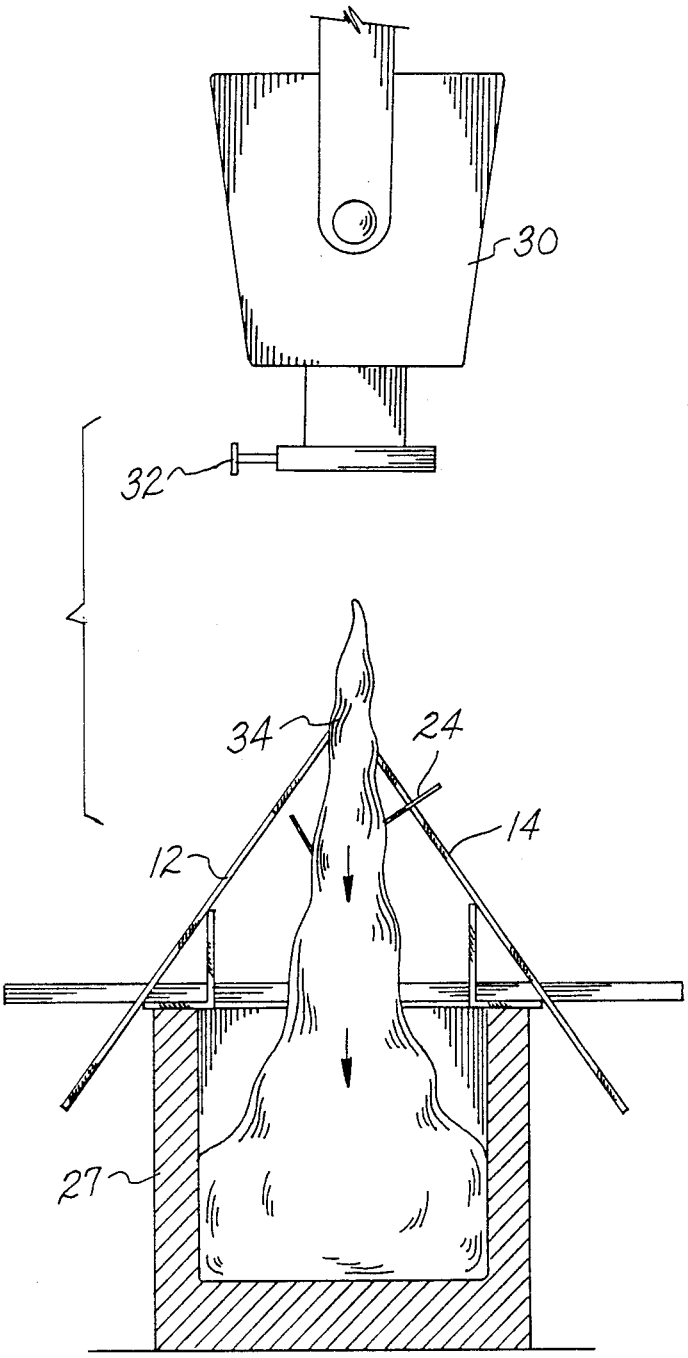

As molten steel column 34 contacts cover 24, the adhesive bond between the cover and sheets 12, 14 is broken and the cover collapses inwardly under the weight of the steel column. As the cover collapses inwardly from the top center, as shown in FIG. 7, the peripheral ends flip upwardly, and any residual impurities 36 still present on the cover will be jettisoned off in the direction of arrows 40. Steel column 34 continues to pass through opening 22 in tent 10, and the heat consumes the cover 24 (FIG. 8). Tent 10 acts to prevent splashing of the steel out of mold 27 until, finally, the heat of steel column causes the tent and wood beams 26 to burn up. It should be noted here that the consumed corrugated paper originally formed into tent 10 and cover 24 as well as the consumed wood from beams 26 create no contaminant problems for the steel ingot (not shown) which is drawn from mold 27 after cooling.

It is understood that the invention is not limited to the details above-given, but may be modified within the scope of the following claims.

What is claimed is:

1. A tent adapted to cover a metal pouring mold, said tent comprising a sheet, means for supporting said sheet above a metal pouring mold, said sheet formed of durable and consumable material and defining a first and second divergent faces angled downwardly with respect to said mold, said sheet formed of corrugated paper material having multiple corrugated layers defined by corrugations running longitudinally through the sheet, said sheet defining a center opening means for allowing pouring of molten metal therethrough into said mold, and a cover positioned over said opening, said cover formed of readily collapsible and consumable material and overlying said sheet first and second faces and supported by said sheet, said cover constituting deflector means for deflecting sand and other impurities away from said mold prior to pouring of said molten metal, said means for supporting said sheet above said metal pouring mold including a consumable bar extending through the sheet and positioned atop said metal pouring mold.

2. The tent of claim 1 wherein said cover is formed of treated paper and fastened to said sheet, said treated paper of sufficient strength to deflect said sand but of insufficient strength to deflect said molten metal away from said mold.

3. The tent of claim 1 wherein said sheet includes first and second sheet members each defining a said first and second face, said first and second sheet members joined at a top edge thereof.

* * * * *